United States Patent [19]

Dunn

[11] Patent Number: 4,478,008

[45] Date of Patent: Oct. 23, 1984

[54] THERMALLY STABILIZED DOUBLE DISC GRINDING MACHINE

[75] Inventor: Elman R. Dunn, Roscoe, Ill.

[73] Assignee: Litton Industrial Products, Inc., Waynesboro, Pa.

[21] Appl. No.: 322,883

[22] Filed: Nov. 19, 1981

[51] Int. Cl.[3] ..... B24B 7/00; B24B 55/00; B24B 41/02; B24B 41/04

[52] U.S. Cl. ..... 51/111 R; 51/356; 51/166 TS; 51/166 MH; 51/266; 51/165.73; 409/135

[58] Field of Search ..... 51/111-118, 51/266, 2 H, 165.73, 166 TS, 166 MH, 356, 266, 267; 409/11, 135-137, 235, 238; 165/47; 184/6.14

[56] References Cited

U.S. PATENT DOCUMENTS

| | | | |
|---|---|---|---|
| 1,638,028 | 8/1927 | Gardner | 51/111 R |
| 2,070,811 | 2/1937 | Sassen | 51/266 |
| 2,424,448 | 7/1947 | Gardner et al. | 51/2 H X |
| 3,503,155 | 3/1970 | Dunn | 51/114 |

*Primary Examiner*—Frederick R. Schmidt
*Assistant Examiner*—Debra S. Meislin
*Attorney, Agent, or Firm*—Spencer T. Smith

[57] ABSTRACT

A double disc grinding machine comprising first and second stock removal assemblies, each including a wheelhead assembly including a base for slidably supporting the wheelhead assembly, a frame for supporting the first and second stock removal assemblies including front and rear walls, each having a vertically extending opening defined therein, a top portion above the opening and a bottom portion below the opening, one of the top portions having a tensile bolster for defining a first liquid container, the other one of the top portions also having a tensile bolster for defining a second liquid container, a reservoir including the bottom portions for defining a third liquid container, each of the containers having inlets and outlets, conduits for connecting the outlet ports of the third container to the inlet ports of the first and second containers and for connecting the outlet ports of the first and second containers and the inlet ports of the third container, the conduit including a fluid recirculating pump.

3 Claims, 7 Drawing Figures

THERMALLY STABILIZED DOUBLE DISC GRINDING MACHINE

Double disc grinding machines use two abrasive discs to remove stock and meet tolerance requirements on two opposite and parallel sides of product components or workpieces.

In such machines, it is critically important to maintain a selected angular relationship between the abrasive discs, which tends to change largely due to grinding thrust forces generated between the discs during stock removal, and also due to unequal expansion and/or contraction of various sections of the machine's principal supportive framework due to thermal changes therein.

These thermal changes are caused by heat generation inherent with the grinding process, the heating and/or cooling effect of the liquid grinding coolant required in most operations, and the fluctuating temperatures of the surrounding shop atmosphere at various elevations above shop-floor level.

For fully automatic operation, loading fixtures can be secured to the machine bed (U.S. Pat. No. 3,503,155) interconnecting the opposing portions of the main machine frame or base, thereby helping to resist the grinding thrust forces.

It is an object of the present invention to provide a double disc grinding machine having a principal supportive integral framework which will effectively neturalize the deflecting forces of grinding pressures, and the undesirable thermal change inequities.

Other objects of the present invention will becomes apparent from the following portion of the specification and from the accompanying drawings which illustrate, in accordance with the mandate of the patent statutes, a presently preferred embodiment incorporating the principles of the invention.

Referring to the drawings.

Figure 1:
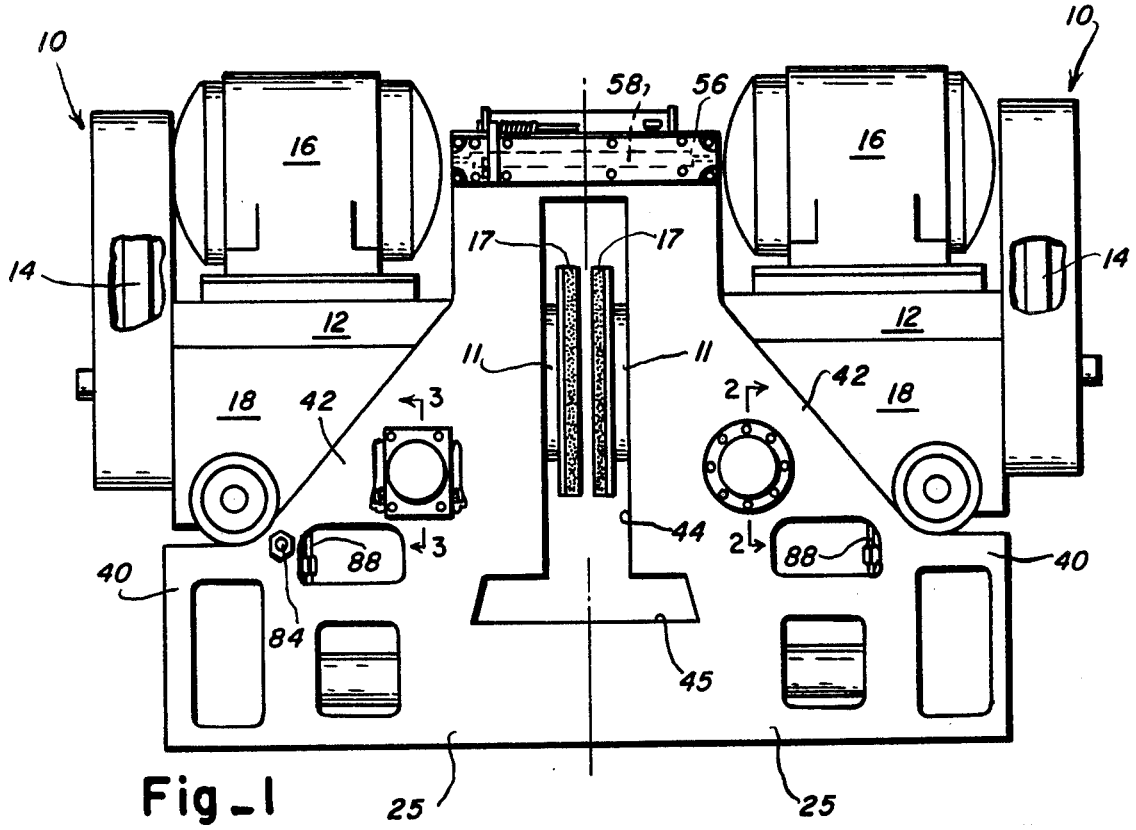
FIG. 1 is a one half front and one half rear elevational view of a double disc grinding machine made in accordance with the teachings of the present invention the other unshown halves are mirrored images of the shown halves.

A double disc grinding machine generally comprises opposing wheelhead assemblies 10, each including a spindle 11 rotatably mounted in an axially slidable housing 12 and driven, via belts 14, by a motor 16 secured to the slidable housing. An abrasive disc wheel 17 is secured to each spindle for effecting stock removal from one of the two opposite flat and parallel surfaces of a workpiece.

Figure 2:
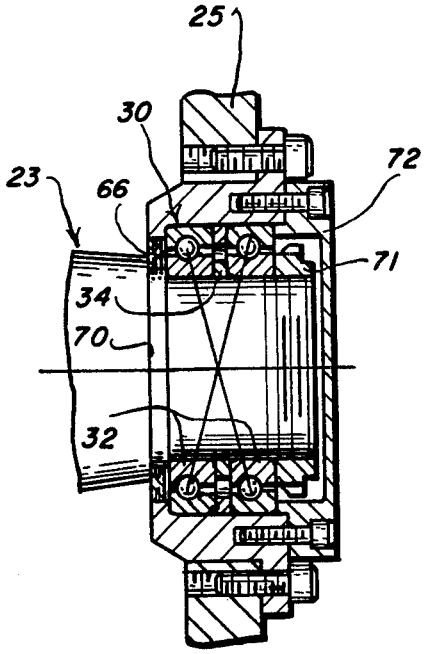
FIG. 2 is a view taken along the lines 2—2 of FIG. 1 illustrating the front pivotal support for a wheelhead assembly of the double disc grinding machine illustrated in FIG. 1.

The wheelhead assemblies are each supported on ways established on a base member 18 for sliding axial displacement toward and away from the workpiece. Each base member includes opposing side walls 20 which have secured thereto coaxial trunnions 22, 23 (FIGS. 2 and 3) which are pivotally supported by upwardly projecting front and back walls 25 of the main machine foundation or frame structure.

The trunnions 22, 23 are supported for limited pivotal movement in ball bearing supports 30, each of which includes a face-to-face mounted pair of ball bearings 32 separated by a cylindrical spacer element 34 having a width selected to locate the bearing load centers coincident on the axis of rotation of the trunnion.

Figure 3:
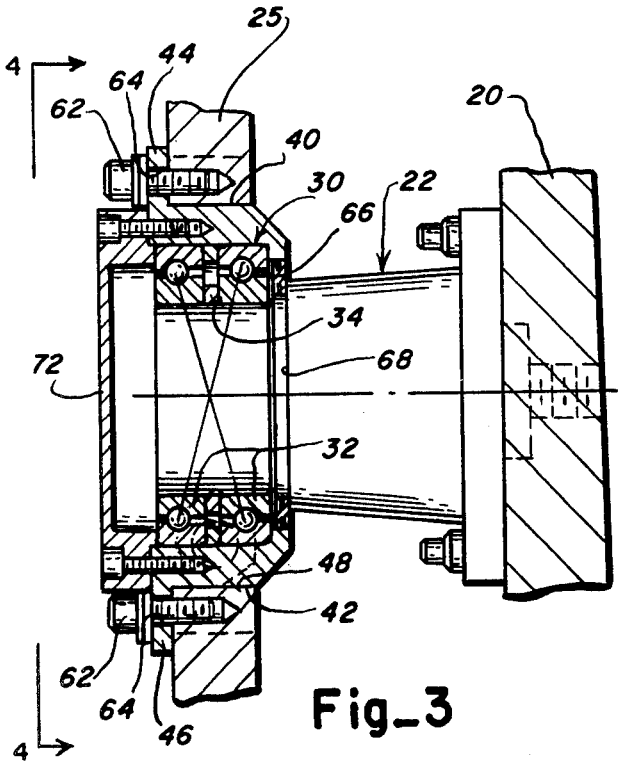
FIG. 3 is a view taken along the lines 3—3 of FIG. 1 similar to that of FIG. 2, but illustrating the rear pivotal support for the wheelhead assembly.

The rear trunnion ball bearing support shown in FIG. 3 includes upper and lower horizontal 40, 42 surfaces and upwardly and downwardly extending flange portions 44, 46. The lower horizontal bearing support surface 42 slidingly engages with the lower 48 horizontal surface of back wall opening 50 of the machine frame.

Figure 4:
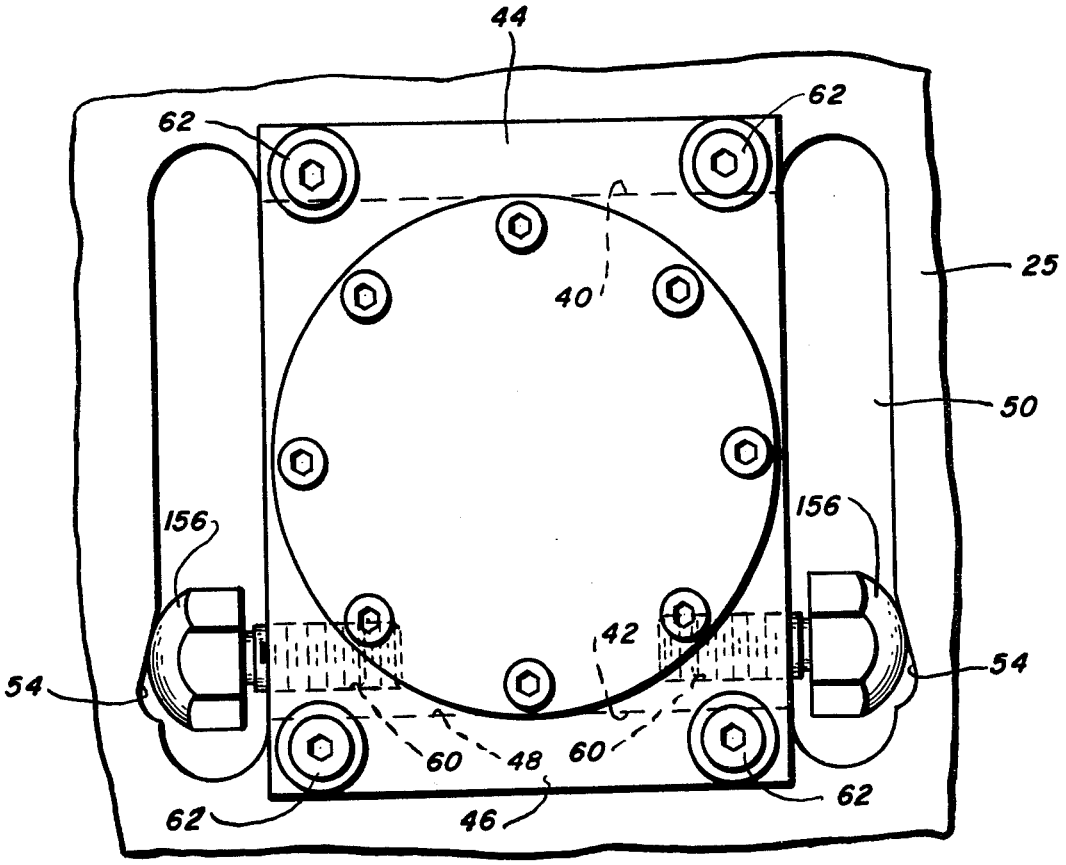
FIG. 4 is a view taken along lines 4—4 of FIG. 3 showing the adjusting means for adjusting the horizontal-plane (swivel) headsetting component.

The rear wall opening 50 (FIG. 4) extends beyond the bearing support and includes selectively inclined surfaces 54 at either end of this opening. The spherical heads 156 of opposed swivel adjustment screws threadedly secured in suitable bearing support bores 60 are forcefully adjusted against these inclined surfaces to establish a selected longitudinal location of the bearing support along the machine frame. The forceful engagement between the spherical heads 156 of the adjusting screws and inclined surfaces 54 produces a downward force through the rear bearing housing to effectively clamp surface 42 against surface 48 of the machine frame.

The rear bearing support is fixedly secured to the rear wall of the machine frame by belleville spring washer preloaded screw assemblies 62. Such screws pass through openings 64 in the bearing support flanges 44 and 46 which are substantially larger than the screws body diameters, therby permitting limited longitudinal adjustment of the bearing support within wall opening 50.

Since a clearance type of annular seal member 66 is provided between the trunnion shoulders 68, 70 and the bearing support, limited reorientation is possible.

A nut 71 threadedly secured to the threaded end of the front trunnion 23 fixedly axially clamps the front trunnion and the entire wheelhead assembly thereby at a fixed transverse location with respect to the machine frame. Suitable covers 72 axially clamp each pair of trunnion bearings outer races under heavy-preload status in each bearing housing to eliminate all internal looseness of the bearings elements.

Figure 5:
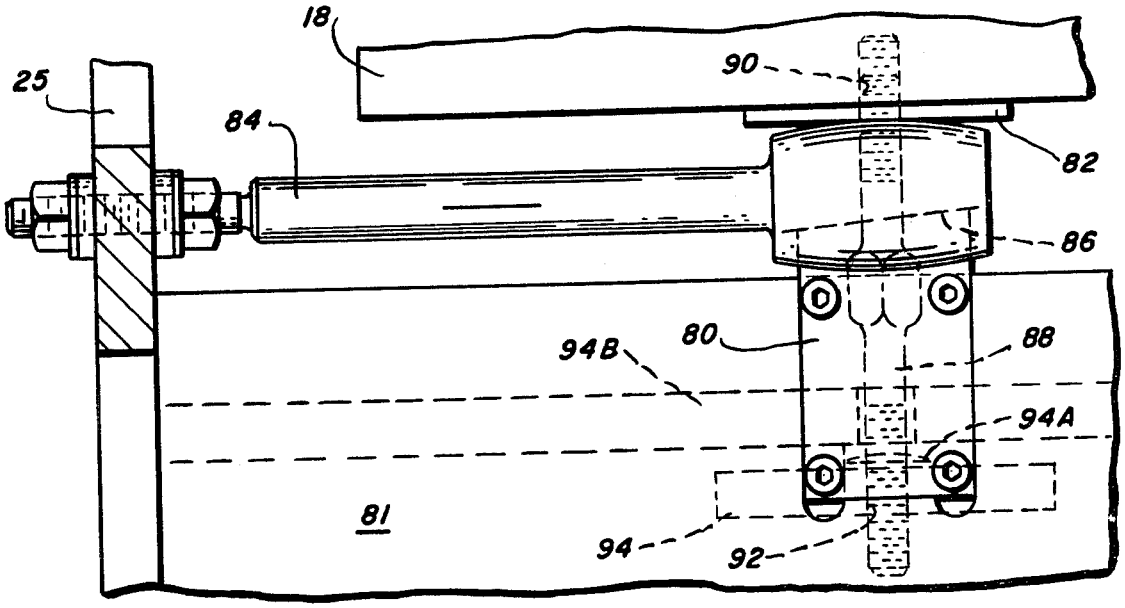
FIG. 5 is a side elevational view of the tilt adjusting assembly for the double disc grinding machine.

To control the tilt of each stock removal assembly, a tilt control assembly (FIG. 5) including a cam element 80 secured to a transverse frame wall 81, a plate 82 secured to the bottom of the adjustable base member 18 which supports the slidable spindle housing, and an axially adjustable control rod 84 having a crowned barrel end with a full-length cam follower surface 86 is provided. The left hand end of control arm 84 is threaded and a pair of bolts 85 on either side of wall 25 secure the control arm 84 at a desired location. To shift the control arm 84 to the left, the rignt hand of the two nuts 85 is rotated to the right (loosened) and the left nut is tightened. As the control arm is shifted axially left to right or right to left, the cam 80, which is a plate member having an inclined surface 86, will raise or lower the right hand end portion of the control arm 86 which is in the form of a cylindrical element having a mating slot defined therein raising or lowering the base member. Adjustment may be maintained with a clamp screw 88 which has it opposing ends threadedly received by a right-hand threaded aperture 90 in the base member 18 and a left-hand threaded aperture 92 in a bar nut 94 which draws tightly upward against a spherical washer assembly 94A underneath a transverse member 94B of the machine frame. This effectively clamps the wheelhead asssembly downward upon the machine frame structure, to insure metal-to-metal contact at all adjoining surfaces of the adjusting mechanism.

Figure 6:
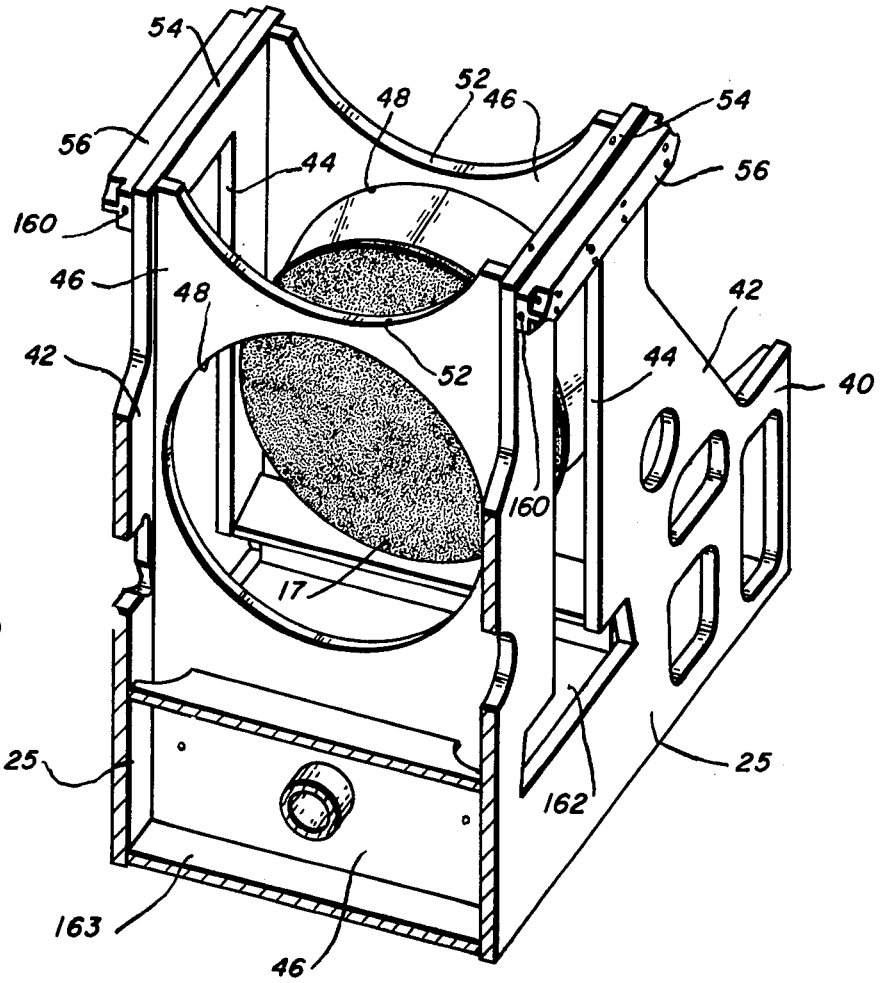
FIG. 6 is an oblique frontal view of a portion of the frame of the double disc grinding machine illustrated in FIG. 1.

The front and back walls 25 (FIG. 1) have an elongated bottom portion 40 and an upwardly extending tapered portion 42. A vertical opening 44 permits the feeding of workpieces into the grinding zone between the opposed abrasive discs. Two parallel cross-walls 46 (FIG. 6) of the machine frame each include an opening 48 through which the spindles 12 which support the abrasive discs can be axially advanced or retracted. These cross-walls extend between the front and back walls 25 on either side of the vertical front and back openings 44, and are secured permanently thereto from a location at the top of the front and back walls and above the abrasive disc opening to a location below the abrasive disc opening and at the bottom edge of front and back walls 25.

An upwardly opening circular cutout 52 is defined at the top of each cross-wall, leaving a cross-wall portion between the cutout 52 and the opening 48. These cutouts 52 provide improved access to facilitate disc replacement and other routine servicing.

The top portion 54 of the front and back walls above the vertical openings 44 is integral with the upwardly extending portions of the front and back walls 25. Top portions 54 each are further strengthened by securing thereto a heavy tensile bolster 76.

Figure 7:
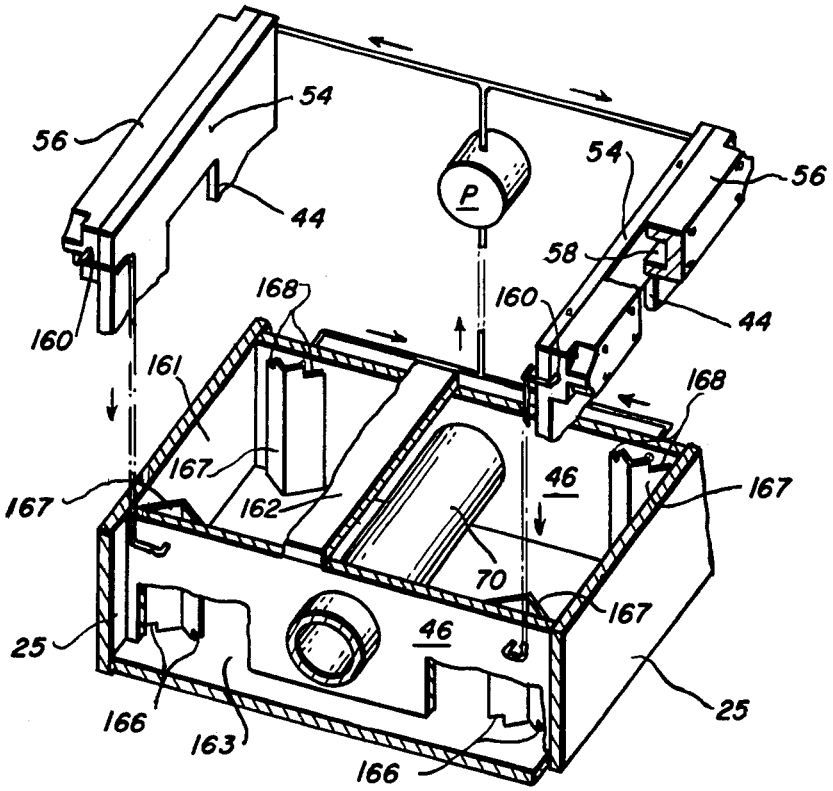
FIG. 7 is an oblique frontal view of a portion of the frame shown in FIG. 6 schematically illustrating a hydraulic thermal control system for equalizing the main framework temperatures at strategic locations.

Each tensile bolster includes an internal channel which defines, with the wall portion 54 (FIG. 7), a fluid tight volume 58. Inlet (not shown) and outlet ports 160 are defined in the tensile bolsters.

The vertical opening 44 (FIG. 1) has a horizontally enlarged portion 45 for coolant flow purposes and for simplifying swarf removal from the grinding zone.

A totally enclosed reservoir 161 is defined by front and rear walls 25, cross-walls 46, a cover-plate 162, and a bottom plate 163 which extends full-length of the frame between walls 25 within the bottom central portion of the principal machine frame, and water or other liquid contained therein is continuously pumped therefrom via a motor driven pump P, through appropriate conduits to and through both tensile bolsters. Since this continuously recirculating liquid is in constant contact with those frame portions which interconnect the sides (top portions 54 including tensile bolsters 56 and bottom portions of the walls 25), these portions will be maintained at the same temperature, thereby preventing uneven longitudinal expansions or contractions which could detrimentally affect the established alignment of the abrasive discs.

To maximize heat distribution in the reservoir or sink 161, integral flow directors 167 contain intake channels 166 open at the bottom of the reservoir and outlet channels 168 open at the top thereof. As is customary practice in conventional recirculatory fluid heat-transfer systems, it is to be understood that both pump intake conduits and/or both pump output conduits may contain flow meters and/or flow regulating valves to balance heat transfer rates (not shown).

A central conduit 70 extends through the reservoir to carry electrical wiring and the like.

A fluid-expansion chamber or device (not shown) may be utilized to maintain 100% liquid fill (no air content) in the totally enclosed thermal stabilizing or equalizing system at all times (within typical range of 60° F. to 120° F. max).

What is claimed is:

1. A double disc grinding machine comprising first and second stock removal assemblies, each including a wheelhead assembly including base means for slidably supporting said wheelhead assembly, frame means for supporting said first and second stock removal assemblies including front and rear wall means, each having a vertically extending opening defined therein, a top portion above said opening and a bottom portion below said opening, said top portion of said front wall means including a tensile bolster and said top portion of said rear wall means including a tensile bolster, means including one of said tensile bolsters for defining a first liquid container, means including said other one of said tensile bolsters for defining a second liquid container, means including said bottom portions for defining a third liquid container, each of said containers having inlet and outlet means, conduit means for connecting the outlet port means of said third container to said inlet port means of said first and second containers and for connecting said outlet port means of said first and second containers and said inlet port means of said third container, said conduit means including a fluid recirculating pump.

2. A double disc grinding machine according to claim 1, wherein said vertically extending opening includes an enlarged bottom portion.

3. A double disc grinding machine according to claim 2, wherein a conduit extends through said third liquid container.

* * * * *